US009242262B2

(12) United States Patent
Huffington et al.

(10) Patent No.: US 9,242,262 B2
(45) Date of Patent: Jan. 26, 2016

(54) BODY SPRAY WITH EXTENDING SPRAYHEAD

(75) Inventors: Todd Andrew Huffington, Avon, IN (US); Garry Robin Marty, Fishers, IN (US); Paul Patton, Indianapolis, IN (US); Daniel Steven Genord, Lyon, MI (US)

(73) Assignee: Delta Faucet Company, Indianapolis, IN (US)

( * ) Notice: Subject to any disclaimer, the term of this patent is extended or adjusted under 35 U.S.C. 154(b) by 916 days.

(21) Appl. No.: 13/481,103

(22) Filed: May 25, 2012

(65) Prior Publication Data

US 2013/0312175 A1 Nov. 28, 2013

(51) Int. Cl.

| | |
|---|---|
| ***A47K 3/00*** | (2006.01) |
| ***B05B 15/06*** | (2006.01) |
| ***B05B 15/10*** | (2006.01) |
| ***E03C 1/04*** | (2006.01) |
| *B05B 1/18* | (2006.01) |

(52) U.S. Cl.

CPC ..... *B05B 15/067* (2013.01); *B05B 15/10* (2013.01); *E03C 1/0408* (2013.01); *B05B 1/18* (2013.01); *E03C 2001/0414* (2013.01); *E03C 2001/0417* (2013.01)

(58) Field of Classification Search

CPC ..... E03C 1/06; E03C 1/063
USPC ..... 4/615, 601, 567, 570
See application file for complete search history.

(56) References Cited

U.S. PATENT DOCUMENTS

| | | | | |
|---|---|---|---|---|
| 4,351,477 | A | 9/1982 | Choi | |
| 6,301,723 | B1 | 10/2001 | Goettl | |
| 7,246,760 | B2 * | 7/2007 | Marty et al. | 239/587.4 |
| 7,389,942 | B2 | 6/2008 | Kenyon et al. | |
| 8,083,158 | B2 | 12/2011 | Katzman et al. | |
| 8,714,463 | B2 * | 5/2014 | Bischoff et al. | 239/209 |
| 2001/0008256 | A1 * | 7/2001 | Marsh et al. | 239/381 |
| 2011/0186653 | A1 | 8/2011 | Cai et al. | |

FOREIGN PATENT DOCUMENTS

| | | |
|---|---|---|
| CN | 2180190 | 10/1994 |
| CN | 2191884 | 3/1995 |
| CN | 2319130 | 5/1999 |
| CN | 2319131 | 5/1999 |
| CN | 2397871 | 9/2000 |
| CN | 2887450 | 4/2007 |
| CN | 201505583 | 6/2010 |
| GB | 2297930 | 8/1996 |
| JP | 2006101914 | 4/2006 |

(Continued)

OTHER PUBLICATIONS

American Standard, "Extender™ Body Sprays Discreetly on Demand" brochure, 2010, 8 pages.

(Continued)

*Primary Examiner* — Huyen Le
(74) *Attorney, Agent, or Firm* — Faegre Baker Daniels LLP

(57) ABSTRACT

A body spray configured to be supported within a shower wall. The body spray includes an outer housing and an inner waterway supporting a sprayhead for axial movement relative to the outer housing. Water pressure against the inner waterway causes the sprayhead to move axially outwardly from a refracted position to an extended position.

31 Claims, 12 Drawing Sheets

(56) References Cited

FOREIGN PATENT DOCUMENTS

| | | |
|---|---|---|
| WO | WO 83/03064 | 9/1983 |
| WO | WO 2011/032369 | 3/2011 |

OTHER PUBLICATIONS

American Standard, "Pekoe™ Single Control Kitchen Faucet Extender Spout", brochure, 2010, 2 pages.

* cited by examiner

BODY SPRAY WITH EXTENDING SPRAYHEAD

BACKGROUND AND SUMMARY OF THE INVENTION

The present invention relates generally to a body spray that mounts within a shower wall and, more particularly, to a body spray that mounts with a low profile against a shower wall when inactive (i.e., not dispensing water), but extends outwardly therefrom when active (i.e., dispensing water).

It is known to utilize body sprays within shower installations. More particularly, it is known to mount body sprays within shower walls wherein the body sprays extend outwardly in response to water pressure.

According to an illustrative embodiment of the present disclosure, a body spray includes an inner waterway received within an outer housing and configured for axial movement between a retracted position and an extended position. When retracted, a spray face is illustratively flush with the front of a face plate. When extended, the front of a bonnet nut is illustratively flush with the front of the face plate. Further, in the extended position the sprayhead may by pivoted about a pivot point positioned forward of the shower wall.

According to a further illustrative embodiment of the present disclosure, a body spray includes a valve body configured to be supported within a shower wall, and an outer housing fluidly coupled to the valve body, the outer housing including a chamber extending along a longitudinal axis. An inner waterway is fluidly coupled to the outer housing, the inner waterway including a longitudinally extending shaft having an inner end and an outer end. A water passageway extends between the inner end and the outer end of the inner waterway. A pivot coupling is supported by the outer end of the shaft, and a bonnet nut secures the pivot coupling to the outer end of the shaft. Water pressure causes the inner waterway to extend longitudinally outwardly relative to the outer housing from a retracted position to an extended position. A sprayhead is fluidly coupled to the pivot coupling of the inner waterway. A faceplate including a central opening is supported by the outer housing and is configured to be positioned external to the shower wall. The sprayhead is positioned within the central opening of the faceplate when the inner waterway is in the refracted position, and the bonnet nut is positioned within the central opening of the faceplate when the inner waterway is in the extended position.

According to another illustrative embodiment of the present disclosure, a body spray includes a valve body configured to be supported within a shower wall, and an outer housing fluidly coupled to the valve body, wherein the outer housing includes a chamber extending along a longitudinal axis. An inner waterway is fluidly coupled to the outer housing, the inner waterway including a longitudinally extending shaft extending between an inner end and an outer end. Water pressure causes the inner waterway to extend longitudinally outwardly relative to the outer housing from a retracted position to an extended position. A sprayhead is fluidly coupled to the outer end of the inner waterway. A pivot point is supported by the outer end of the inner waterway and about which the sprayhead pivots. The pivot point is positioned rearward of the shower wall when the inner waterway is in the retracted position, and the pivot point is positioned forward of the shower wall when the inner waterway is in the extended position.

According to a further illustrative embodiment of the present disclosure, a body spray includes an outer housing, and an inner waterway received within the outer housing. The inner waterway includes a longitudinally extending shaft extending between an inner end and an outer end, and a pivot coupling supported by the outer end of the shaft. Water pressure causes the inner waterway to extend longitudinally outwardly from the outer housing from a refracted position to an extended position. A sprayhead is fluidly coupled to the pivot coupling of the inner waterway. The sprayhead is configured to be uncoupled from the inner waterway when in the extended position.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
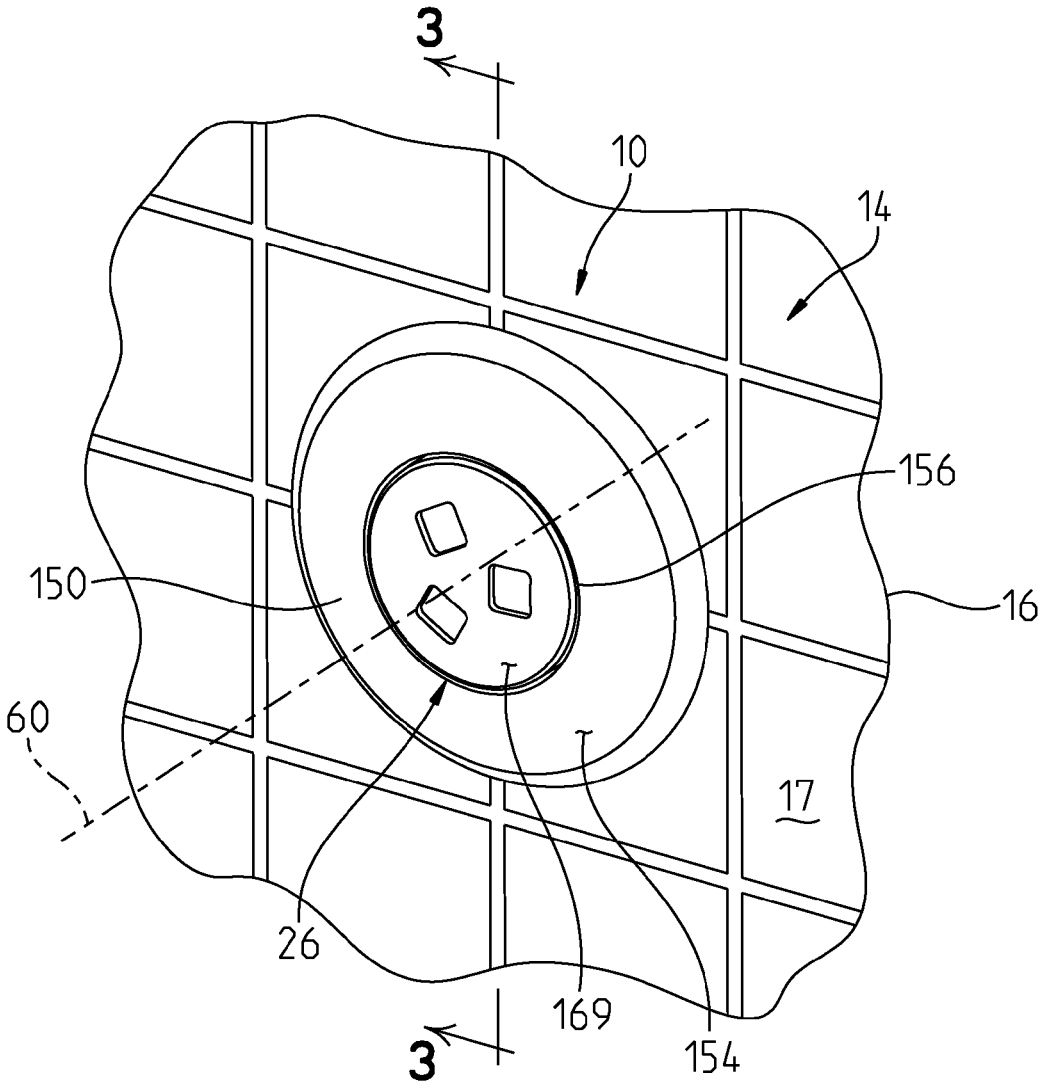
FIG. 1 is a perspective view of an illustrative body spray of the present disclosure supported within a shower wall and in a retracted position.

The embodiments of the invention described herein are not intended to be exhaustive or to limit the invention to precise forms disclosed. Rather, the embodiments selected for description have been chosen to enable one skilled in the art to practice the invention.

Referring initially to FIGS. 1-4, an illustrative body spray 10 is shown received within a conventional wall cavity 12 of a shower wall 14. The shower wall 14 may includes a front wall portion 16 defining a front surface 17, and a stringer 18 positioned behind the front wall portion 16. The body spray 10 includes a valve body 20 supported by the stringer 18. An outer housing 22 is fluidly coupled to the valve body 20, and an inner waterway 24 is fluidly coupled to the outer housing 22 and supported for axial movement relative to the outer housing 22. A sprayhead 26 is fluidly coupled to the inner waterway 24 and supported for pivoting movement relative to the inner waterway 24.

Figure 4:
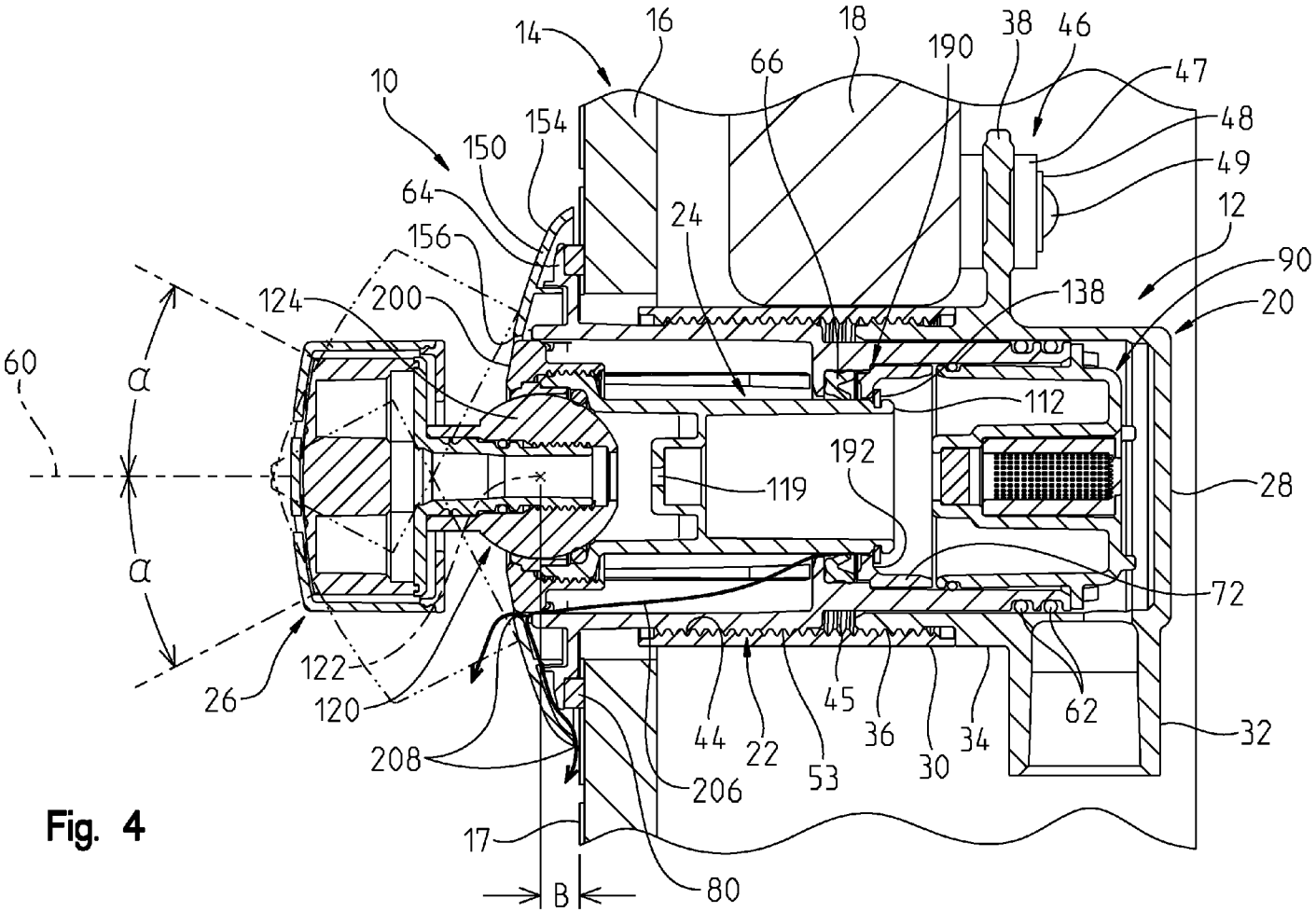
FIG. 4 is a cross-sectional view taken along line 4-4 of FIG. 2.
Figure 5:
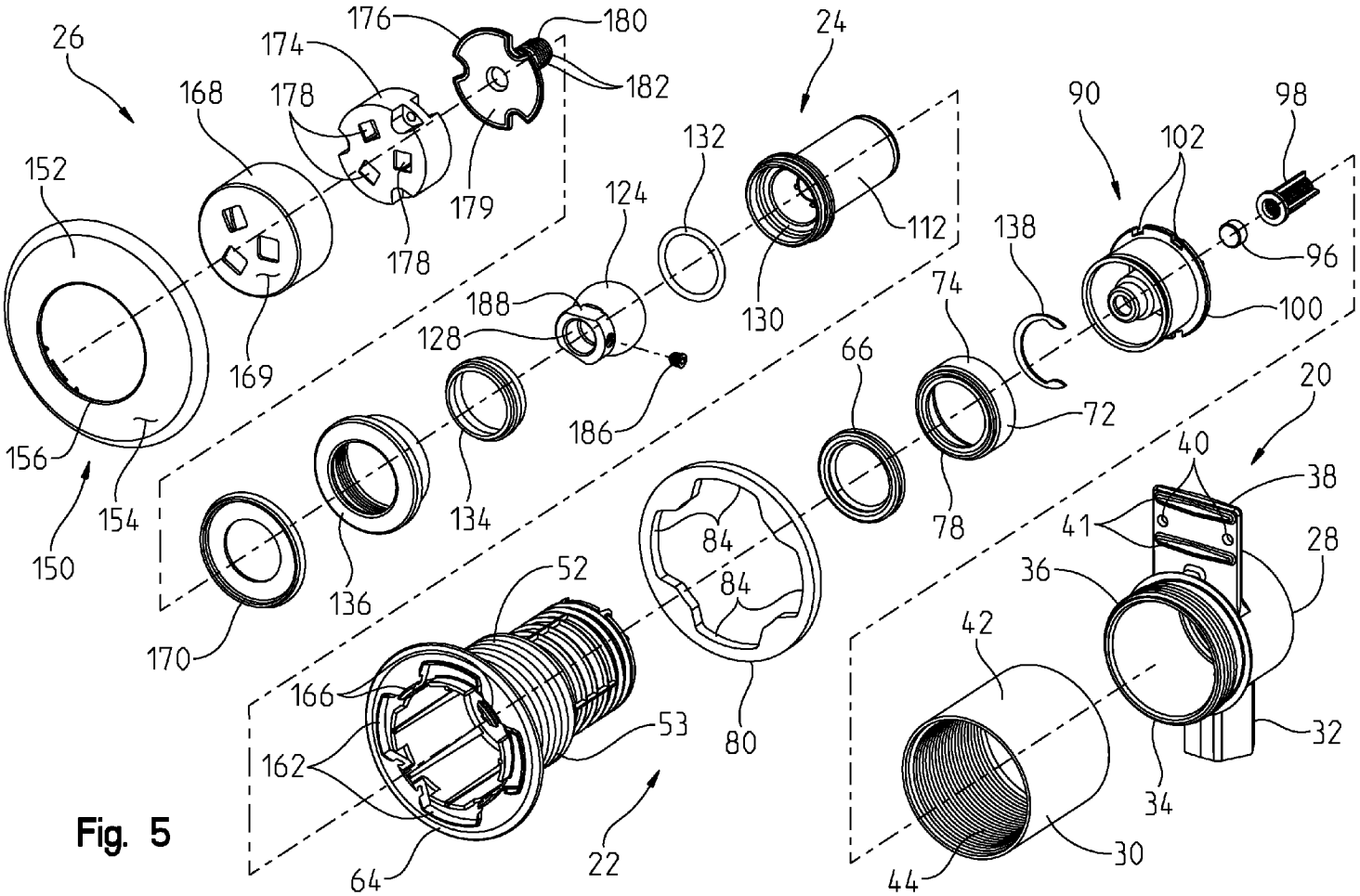
FIG. 5 is a front exploded perspective view of the body spray of FIG. 1.
Figure 6:
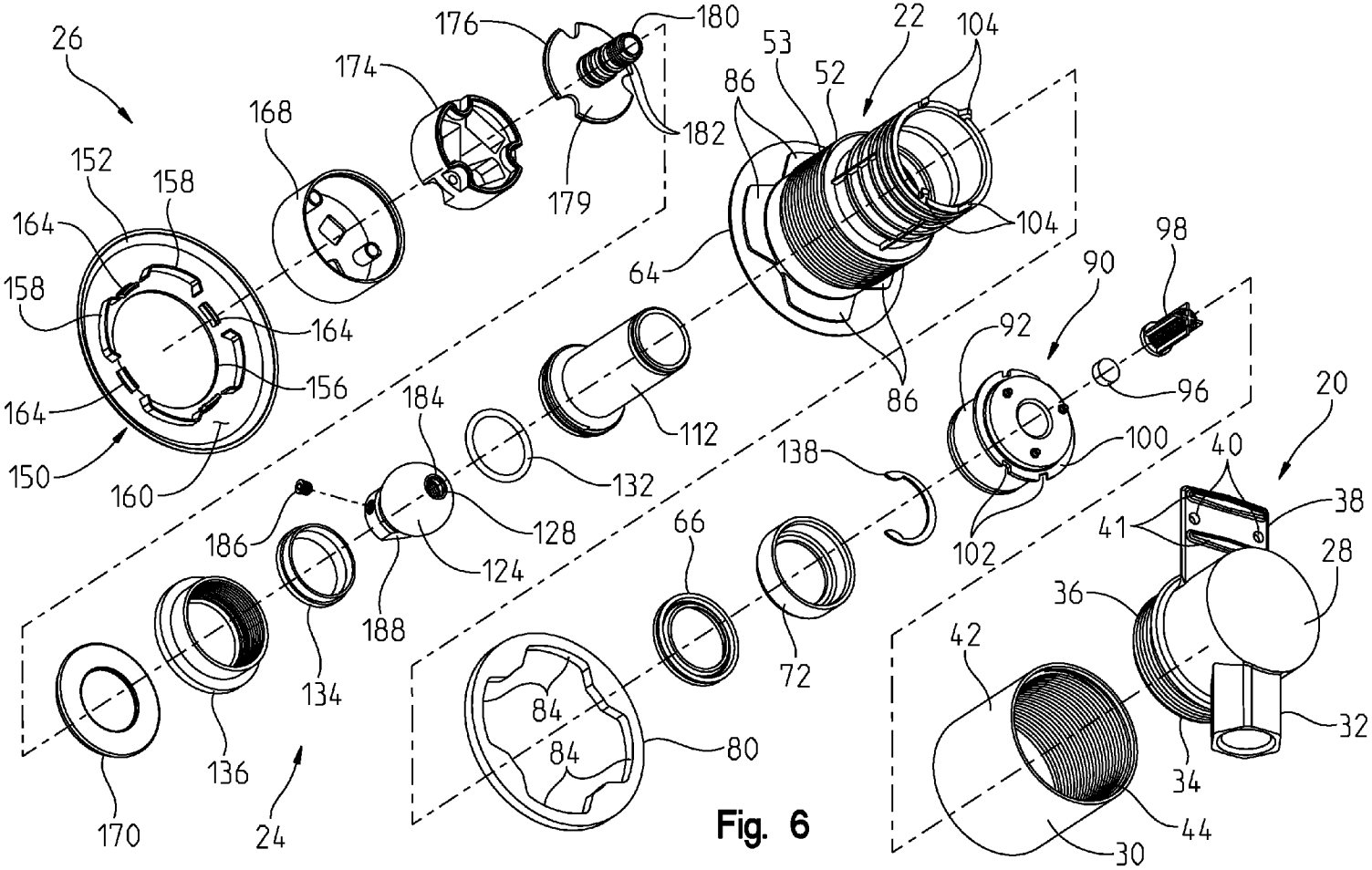
FIG. 6 is a rear exploded perspective view of the body spray of FIG. 1.

With reference to FIGS. 5 and 6, the valve body 20 illustratively includes a support or base 28 coupled to a sleeve 30. The base 28 is illustratively a machined brass forging or casting. The base 28 includes an inlet 32 fluidly coupled to a water supply (e.g., a shower valve) and a cylindrical body portion 34 supporting external threads 36. A mounting bracket 38 is coupled to the body portion 34 and includes a pair of mounting apertures 40 and strengthening ribs 41. The sleeve 30 is illustratively formed of brass and includes a cylindrical side wall 42 concentrically receiving the body portion 34 of the base 28. The cylindrical side wall 42 includes internal threads 44 that threadably couple with the external threads 36 of the base 28. A thread locker 45 may be used to secure together the threads 44 and 36 of the sleeve 30 and the base 28, respectively (FIGS. 3 and 4).

Figure 3:
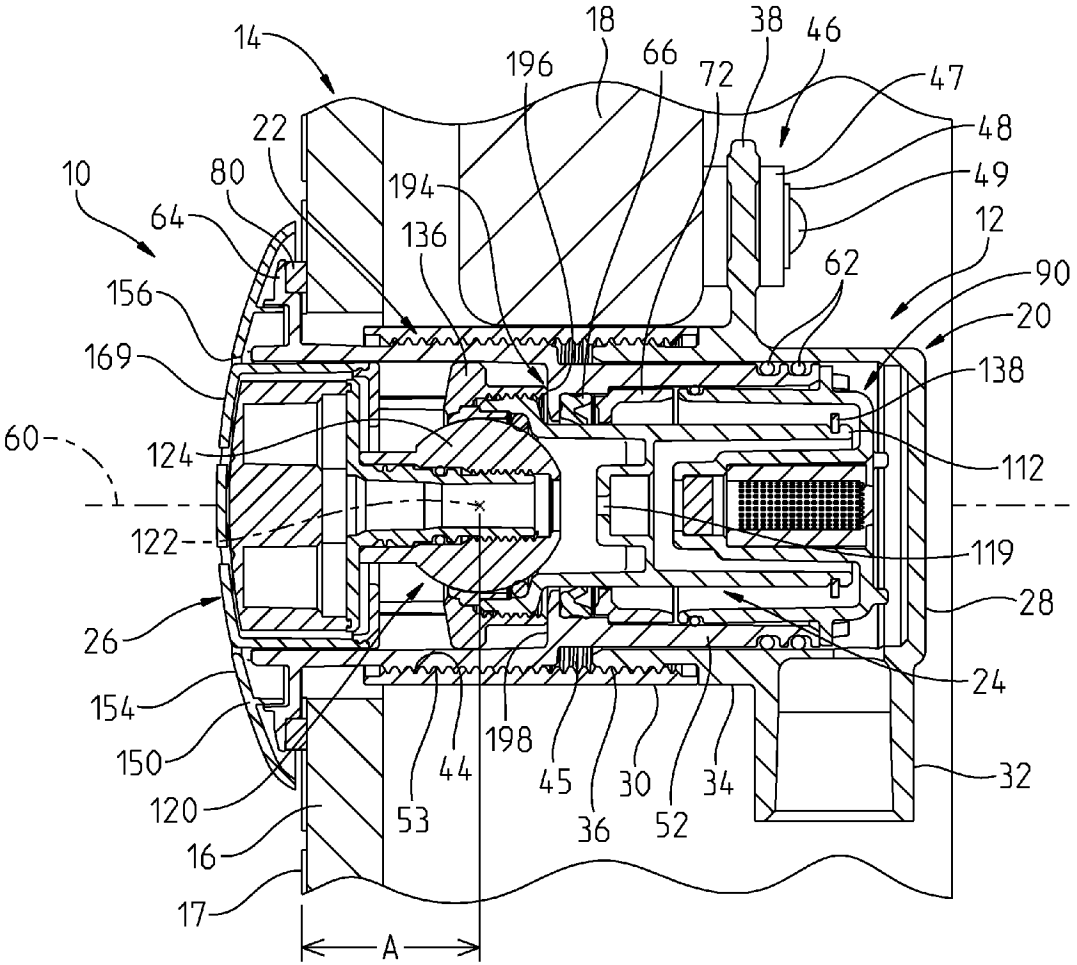
FIG. 3 is a cross-sectional view taken along line 3-3 at FIG. 1.

With further reference to FIGS. 3 and 4, an installer may secure the valve body 20 to the stringer 18 of the shower wall 14 using a resilient mount system 46. The mount system 46 illustratively consists of an elastomeric grommet 47 and a stud or washer 48 that is pre-assembled into the mounting bracket 38 of the base 28. The mount system 46 is secured to the stringer 18 using conventional fasteners, such as screws 49, extending through mounting apertures 40. Such a mount system 46 allows for misalignment when the final assembly of the body spray 10 is performed. Once the valve body 20 is secured to the shower wall 14, a plumbing connection is then secured to the inlet 32.

With reference to FIGS. 3-6, 8, and 9, the outer housing 22 is fluidly coupled to the valve body 20. The outer housing 22 includes an outer housing body 52 supporting external threads 53 and having an inner end 54 and an outer end 56. A chamber 58 extends axially along a longitudinal axis 60. The outer housing 22 may be formed of a polymer. O-rings 62 are concentrically supported proximate the inner end 54 of the housing 22, and a flange 64 is formed proximate the outer end 56 of the housing 22. An elastomeric lip seal 66 is concentrically received within the chamber 58 of the housing 22 and, as further detailed herein, forms a dynamic seal. The lip seal 66 includes a base portion 68 coupled to the inner surface of the housing 22, and a flexible lip portion 70 extending inwardly from the base portion 68. The lip seal 66 is retained by a seal retainer 72 that is supported proximate to the inner end 54 of the outer housing body 52. The seal retainer 72 includes a coupling portion 74 and an engagement ring 78 that engages the base portion 68 of the lip seal 66. The seal retainer 72 may be formed of a polymer and is retained within the housing body 52 by an end housing 90.

Figure 7:
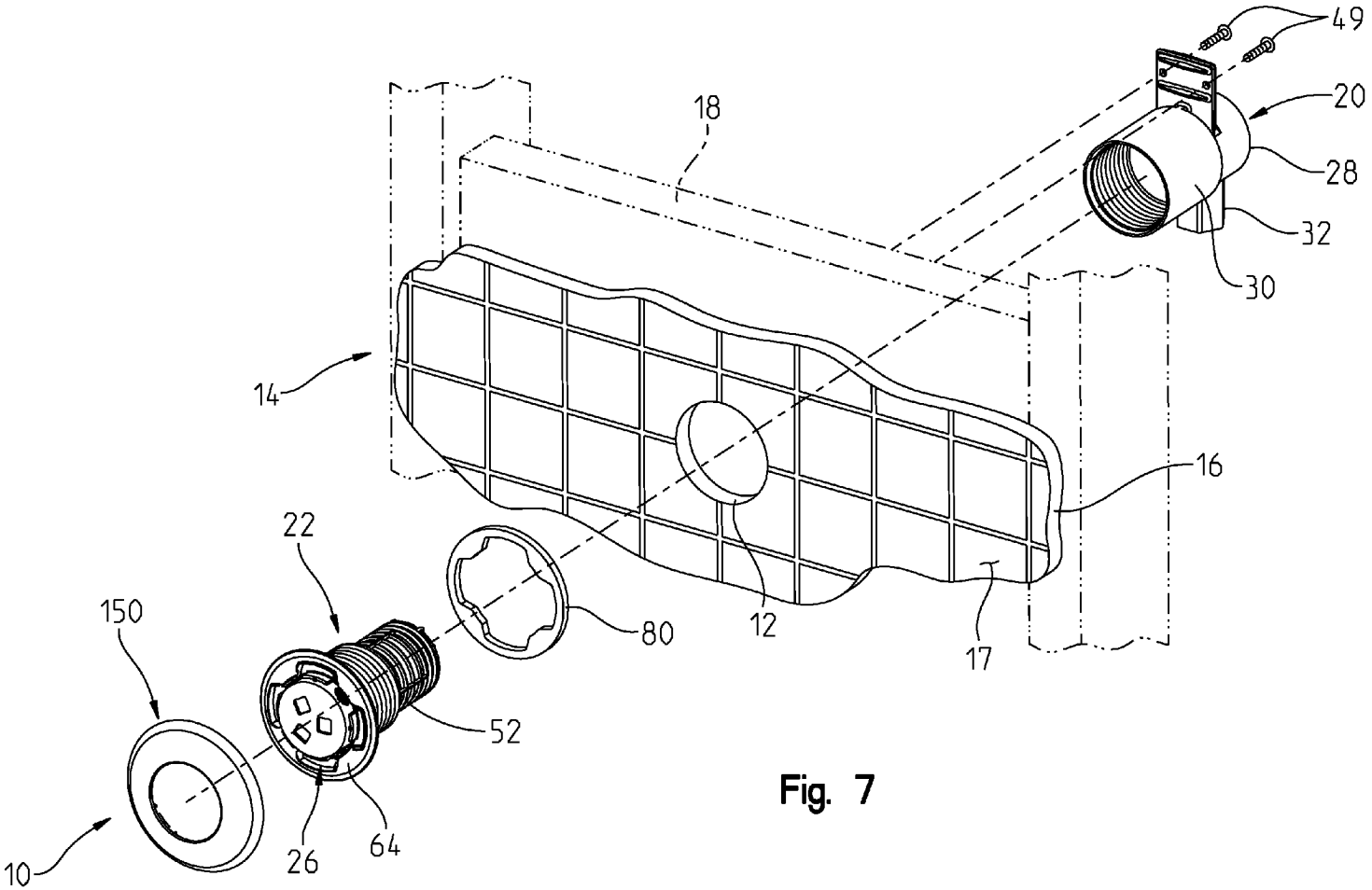
FIG. 7 is a front exploded perspective view illustrating the mounting of the body spray of FIG. 1 to a shower wall.
Figure 8:
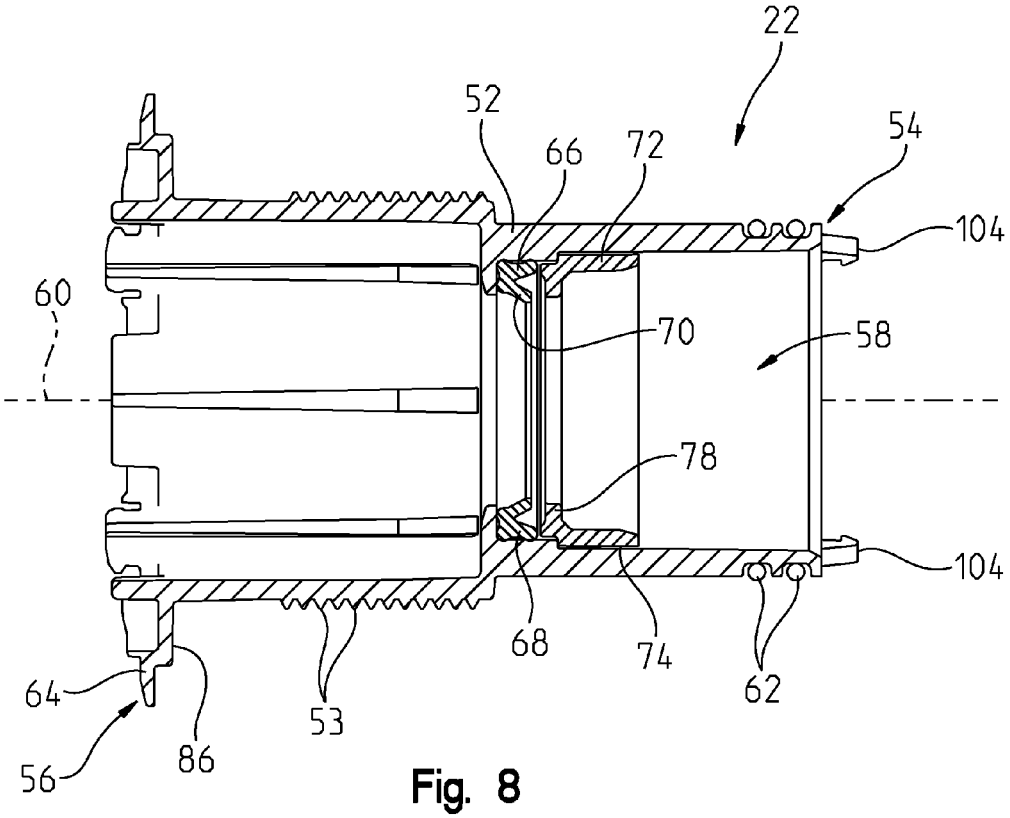
FIG. 8 is a cross-sectional view of the outer housing of the body spray of FIG. 1.
Figure 9:
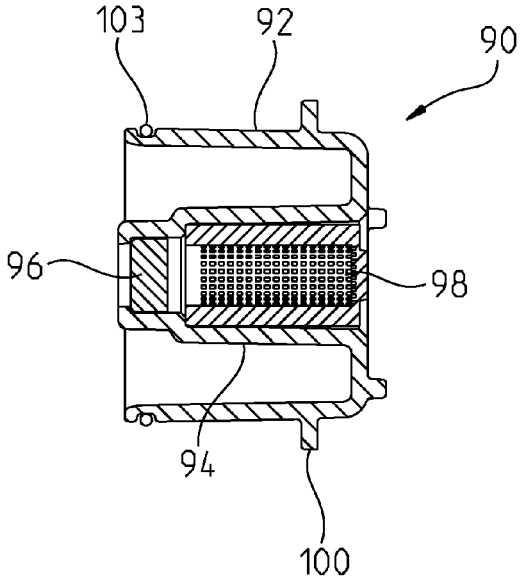
FIG. 9 is a cross-sectional view of the end housing of the body spray of FIG. 1.
Figure 10:
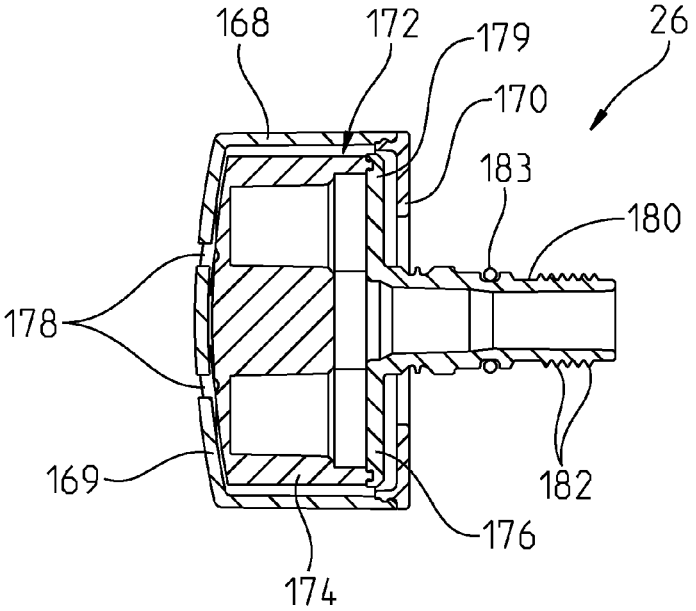
FIG. 10 is a cross-sectional view of the sprayhead of the body spray of FIG. 1.

With reference to FIGS. 5-7, an annular gasket seal 80 is received proximate the flange 64 and is configured to provide a seal with the front surface 17 of the front wall portion 16 of the shower wall 14. Illustratively, the gasket seal 80 is a flexible closed-cell polyethylene foam. The gasket seal 80 may include a plurality of radially extending notches 84 configured to receive corresponding protrusions 86 formed in the rear surface of the flange 64 of the outer housing body 52 for relative positioning therebetween.

As shown in FIGS. 3-6 and 9, an end housing 90 is fluidly coupled to the outer housing 22. More particularly, the end housing 90 includes a body 92 including an inner retainer 94 supporting a flow restrictor 96 and a filter 98. Water passes through the flow restrictor 96 and the filter 98 prior to entering the chamber of the outer housing body 52. The body 92 includes a flange 100 including a plurality of notches 102 cooperating with snap fingers 104 of the outer housing body 52 for securing the end housing 90 thereto. An o-ring 103 may be supported by the end housing body 92 to seal with an inner surface of the outer housing body 52.

Figure 11:
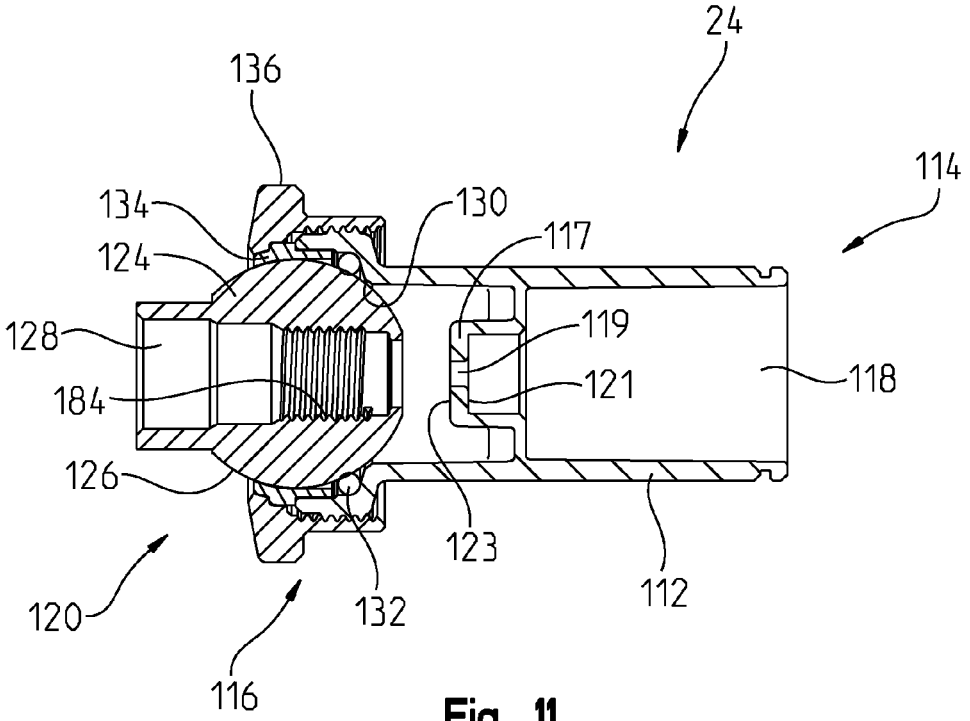
FIG. 11 is a cross-sectional view of the inner waterway of the body spray of FIG. 1.

With reference to FIGS. 3-6 and 10-12, illustrative inner waterway 24 is fluidly coupled to the outer housing 22 and is supported for axial movement relative to the housing body 52. The inner waterway 24 illustratively includes a longitudinally extending shaft 112 having an inner end 114 and an outer end 116. With reference to FIG. 11, a water passageway 118 extends longitudinally between the inner end 114 and the outer end 116. A partition wall 117 is positioned within the water passageway 118 and includes a restricting orifice 119 extending between opposing inner and outer surfaces 121 and 123 of the wall 117. The orifice 119 is configured to provide an increased pressure on the inner surface 121 thereof (i.e., upstream) to force the waterway 24 to move axially outwardly in response thereto.

A pivot coupling 120 defining a pivot point 122 is supported by the outer end 116 of the shaft 112. The pivot coupling 120 is illustratively defined by a shower ball 124 including a semi-spherical outer surface 126 and having a fluid passageway 128 extending therethrough. The ball 124 is supported by a cooperating cavity 130 formed at the outer end 116 of the waterway shaft 112. The ball 124 is captured between a seal, such as an o-ring 132, and a ball retainer 134 by a bonnet nut 136 threadably coupled to the outer end 116 of the waterway shaft 112.

Figure 12:
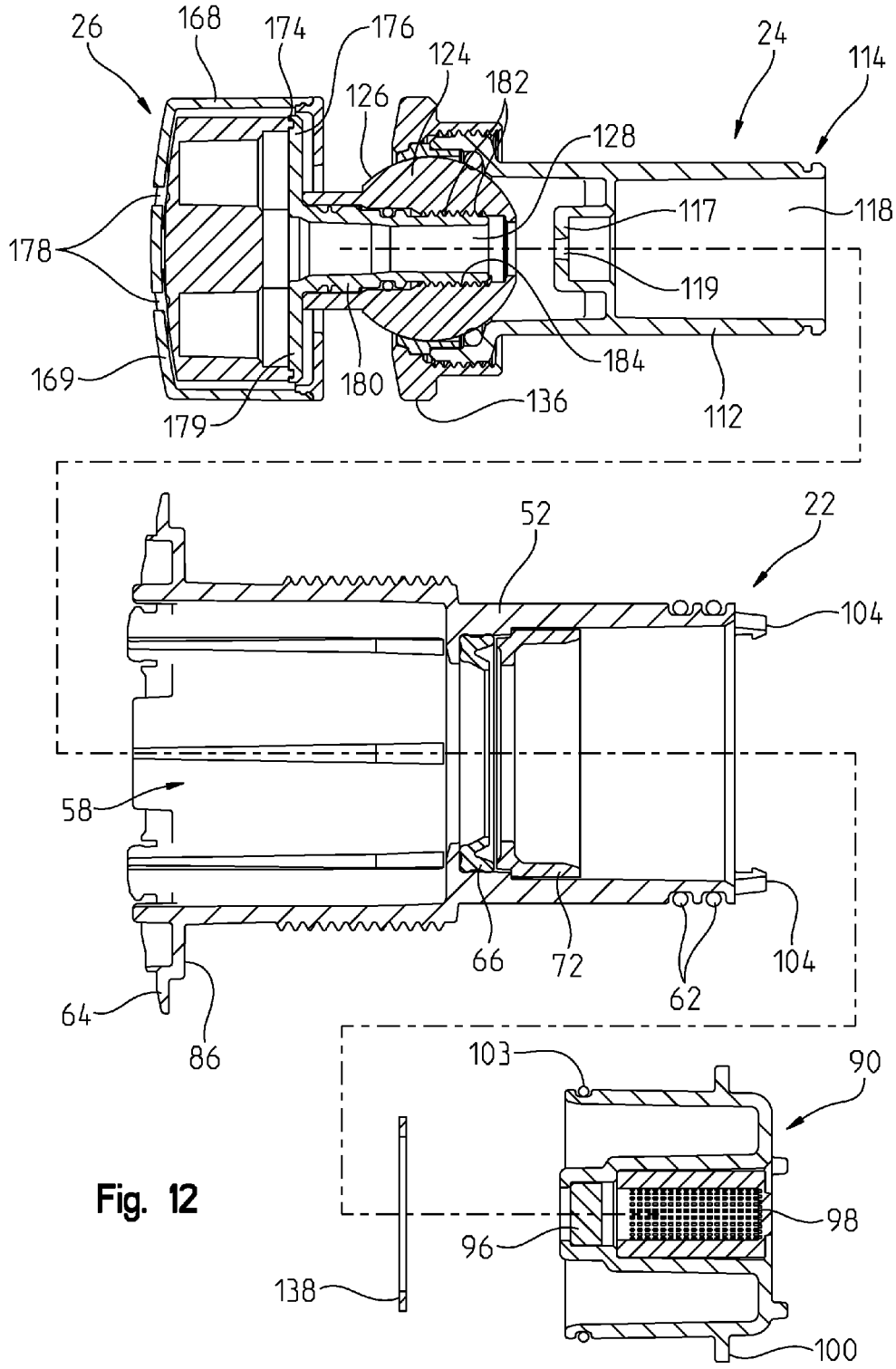
FIG. 12 is a partially exploded cross-sectional view of the body spray of FIG. 1, showing the inner waterway configured to be received within the outer housing.
Figure 13:
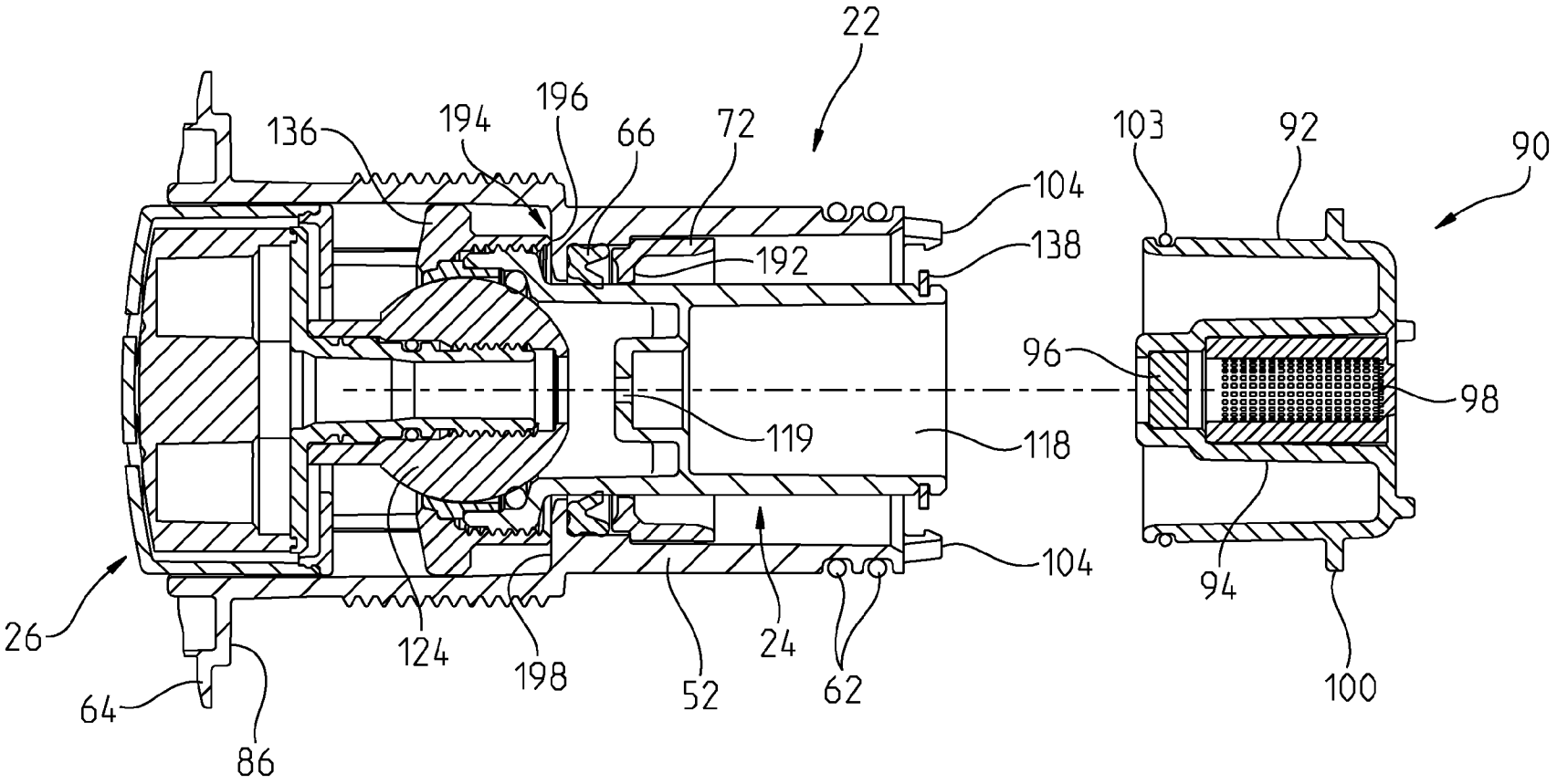
FIG. 13 is a partially exploded cross-sectional view similar to FIG. 12, showing the end housing configured to be coupled to the inner waterway.

The outer housing 22 and the inner waterway 24 are assembled together by sliding the inner end 114 of the shaft 112 through the chamber 58 of the outer housing body 52 (i.e., from left to right in FIG. 12). A retainer, illustratively a snap ring 138 is coupled to the inner end of the waterway shaft 112 to couple the outer housing 22 with the inner waterway 24 while permitting limited axial movement therebetween. The lip seal 66 provides a dynamic seal with the inner waterway 24 by providing a fluid seal between the outer housing body 52 and the waterway shaft 112 as the shaft 112 moves axially (i.e., along the longitudinal axis 60). The end housing 90 may then be secured to the outer housing body 52 through the snap fingers 104 engaging the notches 102 in flange 100 (FIGS. 5, 6, and 13).

Figure 14:
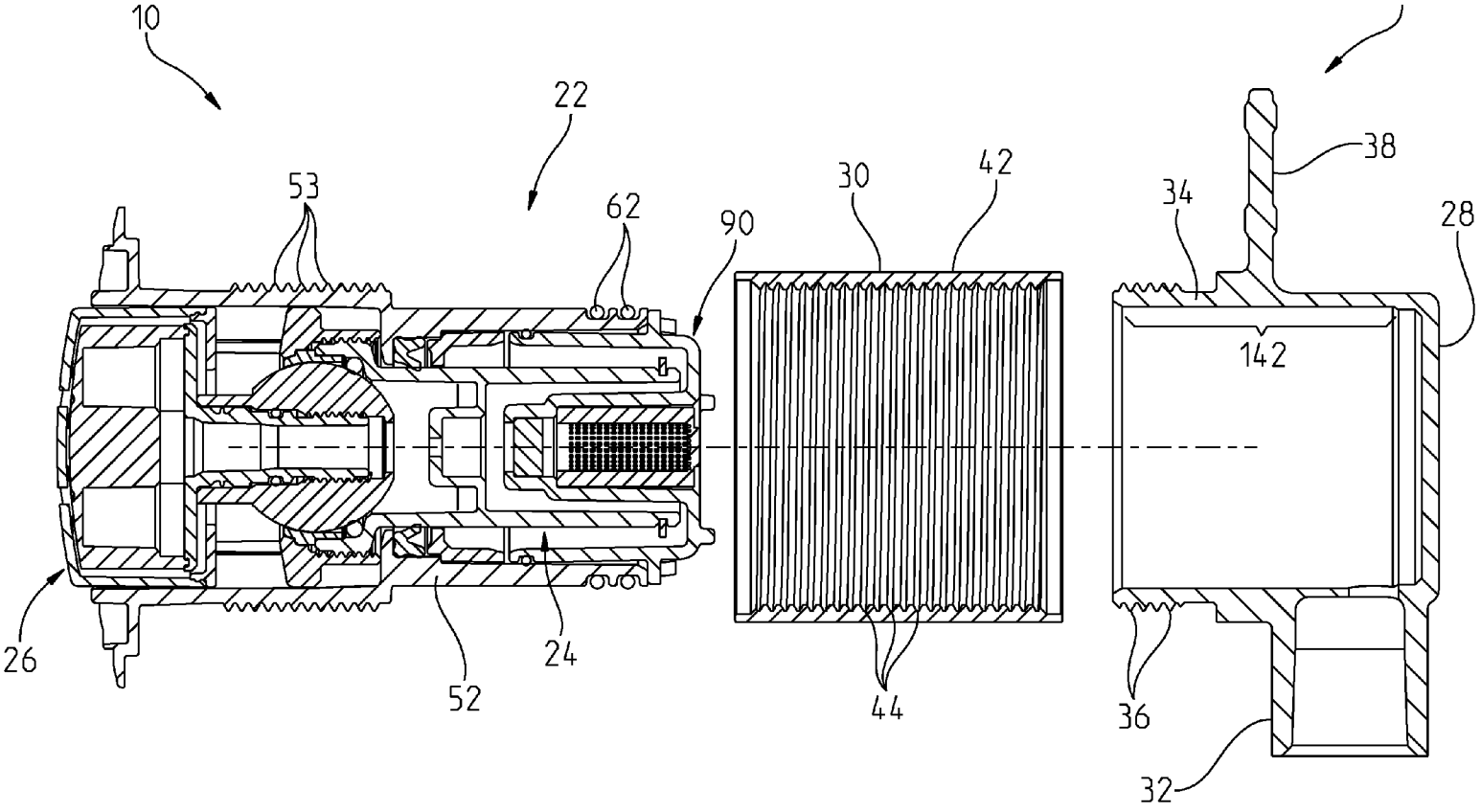
FIG. 14 is a partially exploded cross-sectional view of the body spray of FIG. 1, showing the assembly of FIG. 13 configured to be received within the valve body.

With reference to FIG. 14, the assembled outer housing 22, inner waterway 24 and end housing 90 are received within the valve body 20. External threads 53 on the outer housing body 52 threadably couple with internal threads 44 on the sleeve 30. A drive tool (not shown) with drive features that fit into the housing 22 may be used to drive the assembly into the valve body 20. A hex drive feature on the drive tool may be engaged by a socket or other wrench to assist in rotating the tool. Alternatively, the drive tool may include a handle configured to be grasped by a user.

O-rings 62 provide a fluid seal between the outer housing body 52 and the valve body 20. As shown in FIG. 14, a broad axially extending land area 142 is provided on the inner surface of the base 28 of valve body 20 so that varying thicknesses of the front wall portion 16 may be accommodated. More particularly, the land area 142 permits axial adjustment of the outer housing body 52 within the wall cavity 12 (via threading and unthreading of the outer housing 22 within the sleeve 30) to accommodate varying wall thicknesses. The gasket seal 80 seals against the front wall surface 17, thereby preventing water intrusion behind the front wall portion 16.

With reference to FIGS. 3-6, a faceplate or escutcheon 150 is attached to the outer end of the outer housing 22. The faceplate 150 includes a body 152 having a front surface 154 and defining a central opening 156. A plurality of circumferentially spaced locating elements 158 extend inwardly from an inner surface 160 of the faceplate 150 and cooperate with extensions 162 extending outwardly from the flange of the outer housing body 52 to properly orient the faceplate 150 relative to the outer housing 22. Circumferentially spaced snap fingers 164 supported by the inner surface 160 of the faceplate 150 engage with snap fingers 166 supported by the flange of the outer housing body 52 to secure the faceplate 150 to the outer housing 22. Alternatively, other conventional fasteners, such as thread cutting or forming screws, may be used.

With reference to FIGS. 5, 6, and 12, illustrative sprayhead 26 is removably coupled to the ball 124. More particularly, the sprayhead 26 may be removed from the ball 124 and replaced with a different sprayhead 26 as desired by the user. In the illustrative embodiment, the sprayhead 26 includes an outer shell 168 cooperating with an inner cover 170 to define an internal chamber 172. The outer shell 168 illustratively defines a front or spray surface 169. A spray engine 174 is received within the chamber 172 to direct water from the ball 124 outwardly away from the front surface 17 of the shower wall 14. A connector 176 is coupled to the spray engine 174 and directs water from the ball 124 to the spray engine 174.

The spray engine 174 includes a plurality of outlets 178 that may be defined by nozzles or other fluidic devices. In one illustrative embodiment, multi-dimensional fluidic devices may be assembled into the spray engine 174. Such fluidic devices are configured to produce a stream or jet of water moving in at least two dimensions. Such fluidic devices may comprise any number or combination of two-dimensional (2D) fluidic devices and/or three-dimensional (3D) fluidic devices.

2D fluidic devices are configured to produce a fan of water within a plane by oscillating a water stream about a center axis. 3D fluidic devices are configured to produce a pair of interacting fans of water. In general, each 3D fluidic device comprises a pair of adjacent 2D fluidic devices disposed parallel to each other. Moreover, the 3D effect may be produced by combining two 2D fluidic devices that have initially converging fans of water that upon contact proximate a center plane reflect outwardly away from each other. Illustratively, the fans of water are formed by oscillating water streams about a respective center axis within initially converging planes. At the convergence point, the fans of water reflect away from each other in diverging planes, thereby moving in a direction away from the center plane. In the illustrative embodiment, three (3) circumferentially spaced fluidic devices are supported in the spray engine 174 of the sprayhead 26. Illustratively, the fluidic devices may be of the type manufactured by Bowles Fluidics Corporation of Columbia, Md., USA. Additional details of fluidic devices are provided in PCT International Patent Application Publication No. WO 2012/050894 to Masco Corporation of Indiana.

The connector 176 includes a base 179 and a hollow shaft 180 having external threads 182. The external threads 182 of the shaft 180 threadably couple with internal threads 184 within the passageway 128 of the ball 124. A seal, such as an o-ring 183, may be supported by the shaft 180. The o-ring 183 is received within the passageway 128 of the ball 124 and provides a fluid seal between the ball 124 and the connector 176. A set screw 186 is provided within the ball 124 and engages the shaft 180 to prevent unintentional unthreading of the sprayhead 26 from the ball 124. Flats 188 are provided on the ball 124 to facilitate use of a tool in the installation and removal of the sprayhead 26 from the ball 124. More particularly, a tool (e.g., a wrench) may engage flats 188 to prevent rotation of the ball 124 during threading of the sprayhead 26 thereto.

Figure 2:
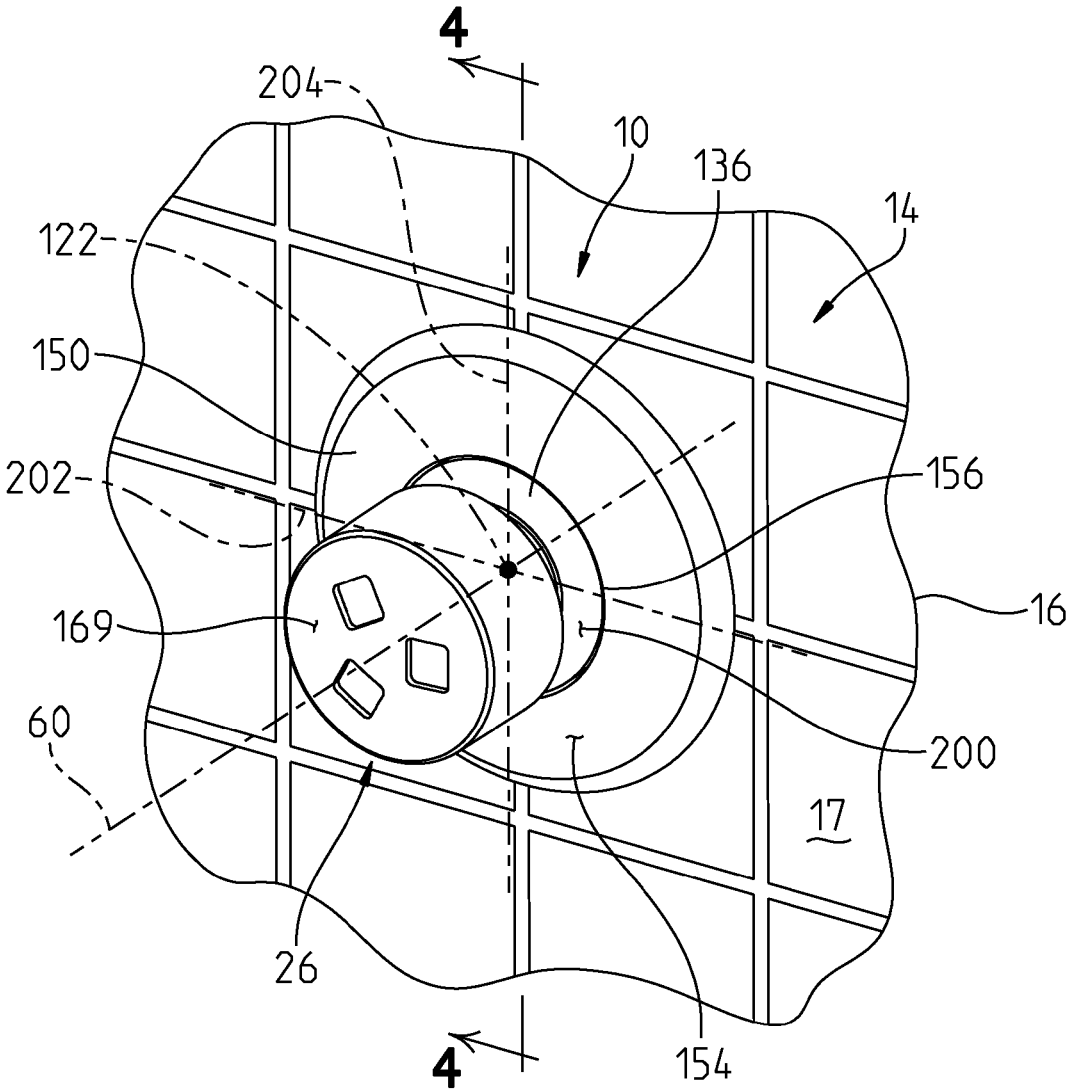
FIG. 2 is a perspective view similar to FIG. 1, illustrating the body spray in an extended position.

The sprayhead 26 is configured to move axially outwardly in response to water pressure. As such, the sprayhead 26 is retracted when inactive (i.e., no water pressure applied to the inner waterway 24) and extended when active (i.e., water pressure applied to the inner waterway 24). FIGS. 1 and 3 show the sprayhead 26 its retracted position, while FIGS. 2 and 4 show the sprayhead 26 in its extended position. Water passing through the valve body 20, flows into the outer housing 22, and into the passageway 118 of the inner waterway 24. As water passes through the restricting orifice 119, a pressure differential is created on opposite sides of partition wall 117. More particularly, increased pressure on the inner surface 121 of wall 117 (i.e., upstream) forces the inner waterway 24 outwardly such that the sprayhead 26 moves to the extended position.

With reference to FIGS. 4 and 13, outward travel or extension of the sprayhead 26 is limited by a stop 190 defined by engagement of the snap ring 138 with a stop surface 192 supported by the seal retainer 72. As detailed above, the sprayhead 26 is pushed out from the shower wall 14 by the pressure of water acting on it. With reference to FIGS. 3 and 13, inward travel or retraction of the sprayhead 26 is limited by a stop 194 defined by the engagement of a rear surface 196 of the bonnet nut 136 with an outer surface 198 of the outer housing body 52.

With further reference to FIGS. 1 and 3, when pushed back into a retracted position, the front surface 169 of the sprayhead 26 is illustratively received within the central opening 156 of the faceplate 150, and more particularly is illustratively flush with the front surface 154 of the faceplate 150. With reference to FIGS. 2 and 4, when extended, a front surface 200 of the bonnet nut 136 is illustratively received with the central opening 156 of the faceplate 150, and more particularly is illustratively flush with the front surface 154 of the faceplate 150.

When extended, the sprayhead 26 may be adjusted via the pivot coupling 120. In the illustrative embodiment shown in FIG. 2, the pivot coupling 120 as defined by the shower ball 124 supported by the waterway 24 is a ball-and-socket joint providing three degrees of freedom to the sprayhead 26. More particularly, a first degree of freedom is rotational movement of the sprayhead 26 about the longitudinal axis 60, a second degree of freedom is rotational movement (e.g. pivoting) about a first transverse axis 202 extending perpendicular to the longitudinal axis 60, and a third degree of freedom is rotational movement (e.g. pivoting) about a second transverse axis 204 extending perpendicular to the longitudinal axis 60 and the first transverse axis 202. The longitudinal axis 60, the first transverse axis 202, and the second transverse axis 204 all intersect at the pivot point 122. Adjustment about the longitudinal axis 60 is also possible by rotating the entire inner waterway 24 with respect to the lip seal 66. This is accomplished by grabbing the sprayhead 26 and rotating the sprayhead 26 about the longitudinal axis 60 through the lip seal 66. While first transverse axis 202 is shown in FIG. 2 as being substantially horizontal, and the second transverse axis 204 is shown as being substantially vertical, it should be appreciated that these axes 202 and 204 may be oriented anywhere within a perpendicular plane intersecting the longitudinal axis 60 at pivot point 122 (i.e., representing a Cartesian coordinate system).

When in the retracted position, the pivot point 122 is positioned rearward of the front surface 17 of the shower wall 14. In the illustrative embodiment shown in FIG. 3, the pivot point 122 is positioned a distance A behind the front surface 17 of the shower wall 14. Illustratively, A is equal to approximately 1.095 inches. When in the extended position shown in FIG. 4, the pivot point 122 is position forward of the front surface 17 of the shower wall 14. In the illustrative embodiment, the pivot point 122 is positioned a distance B in front of the front surface 17 of the shower wall 14. Illustratively, B is equal to approximately 0.255 inches. As such, the total axial travel of the inner waterway 24 and the sprayhead 26 is equal to approximately 1.35 inches.

With further reference to FIG. 4, when the inner waterway 24 is extended, the sprayhead 26 is configured to pivot about either the first transverse axis 202 or the second transverse axis 204 by an angle $\alpha$ in a first direction, and by an angle $\alpha$ in a second direction opposite to the first direction. Pivoting travel is limited by pivot limit stops which are illustratively defined by contact between the shower ball 124 and the ball retainer 134. Illustratively, the angle $\alpha$ is approximately 25 degrees. More particularly, the sprayhead 26 may be pivoted about the first transverse axis 202 upwardly by approximately 25 degrees and pivoted about the first transverse axis 202 downwardly by approximately 25 degrees. The sprayhead 26 may be pivoted about the second transverse axis 204 to the left by approximately 25 degrees and pivoted about the second transverse axis 204 to the right by approximately 25 degrees.

As shown in FIG. 4, if the lip seal 66 should leak, the outer housing 22 is designed such that water would drip outside of the finished wall into the shower. An illustrative leakpath 206 is shown by the arrows in FIG. 4 as extending within outer housing 22 and having outlets 208 forward of the front surface 17 of the shower wall 14. The outlets 208 of the leakpath 206 are illustratively between the bonnet nut 136 and the faceplate 150 and/or between the shower wall 14 and the faceplate 150.

In operation, water supplied to the valve body 20 passes to the outer housing 22 and then to the inner waterway 24. The increased pressure resulting from the restricting orifice 119 in passageway 118 forces the inner waterway 24 and the sprayhead 26 from the retracted position outwardly to the extended position. Water continues to flow through the passageway 118 of the inner waterway 24, through the shower ball 124, and into the sprayhead 26. Water is dispensed through the outlets 178.

In the extended position, the user may manually adjust the sprayhead 26 about the pivot coupling 120 (for example, the sprayhead 26 may pivot about multiple axes, such as longitudinal axis 60, first transverse axis 202, and second transverse axis 204). When in the extended position, the user may remove the sprayhead 26 by loosening set screw 186, and then unthreading the sprayhead 26 from the shower ball 124. Another sprayhead 26 may be reinstalled by threading the sprayhead 26 to the shower ball 124 and then tightening the set screw 186. To retract the sprayhead 26, the user aligns the sprayhead 26 along the longitudinal axis 60 and then pushes the sprayhead 26 back toward the shower wall 14.

Although the invention has been described in detail with reference to certain preferred embodiments, variations and modifications exist within the spirit and scope of the invention as described and defined in the following claims.

The invention claimed is:

1. A body spray comprising:

an outer housing configured to be supported within a shower wall, the outer housing including a chamber extending along a longitudinal axis;

an inner waterway fluidly coupled to the outer housing, the inner waterway including a longitudinally extending shaft having an inner end and an outer end, a water passageway extending between the inner end and the outer end, a pivot coupling supported by the outer end of the shaft, and a bonnet nut having a front surface and securing the pivot coupling to the outer end of the shaft, wherein water pressure causes the inner housing assembly to extend longitudinally outwardly from the outer housing from a retracted position to an extended position;

a sprayhead fluidly coupled to the pivot coupling of the inner waterway and defining a front spray surface; and a faceplate supported by the outer housing and configured to be positioned external to the shower wall, the faceplate including a central opening;

wherein the sprayhead is positioned within the central opening of the faceplate when the inner waterway is in the retracted position, and the bonnet nut is positioned within the central opening of the faceplate when the inner waterway is in the extended position;

wherein the front spray surface of the sprayhead is flush with a front surface of the faceplate when the inner waterway is in the retracted position, and the front surface of the bonnet nut is flush with the front surface of the faceplate when the inner waterway is in the extended position.

2. The body spray of claim 1, further comprising a valve body configured to be supported within the shower wall, and the outer housing is received within the valve body.

3. The body spray of claim 2, wherein the outer housing is threadably coupled to the valve body, and the valve body includes an axially extending land area to accommodate varying shower wall thicknesses.

4. The body spray of claim 1, wherein the outer housing includes an outer housing body, a lip seal received within the outer housing body, and a retainer coupled to the outer housing body, the lip seal positioned concentrically around the inner waterway and providing a dynamic seal between the outer housing and the inner waterway.

5. The body spray of claim 4, wherein the outer housing body extends between an inner end and an outer end, the outer housing body including a flange at the outer end, and an annular seal is positioned intermediate the flange and an outer surface of the shower wall.

6. The body spray of claim 1, wherein the pivot coupling of the inner waterway includes a ball having a semi-spherical outer surface and a water passageway extending therethrough.

7. The body spray of claim 1, further comprising an end housing fluidly coupled to the inner end of the outer housing, a flow restrictor supported within the end housing.

8. The body spray of claim 1, wherein the inner waterway includes a restricting orifice within the water passageway to provide a pressure differential to force the waterway toward the extended position in response to water flowing therethrough.

9. The body spray of claim 1, wherein the sprayhead includes an outer shell, an inner cover cooperating with the outer shell to define a chamber, and a spray engine received within the chamber and fluidly coupled to the inner waterway.

10. The body spray of claim 1, wherein the pivot coupling defines a pivot point about which the sprayhead pivots, the pivot point being positioned rearward of the shower wall when the inner waterway is in the retracted position, and the pivot point being positioned forward of the shower wall when the inner waterway is in the extended position.

11. The body spray of claim 10, wherein the sprayhead includes at least three degrees of freedom, the three degrees of freedom including rotation about the longitudinal axis, pivoting about a first transverse axis extending perpendicular to the longitudinal axis, and pivoting movement about a second transverse axis extending perpendicular to the longitudinal axis and the first transverse axis.

12. The body spray of claim 1, wherein a leakpath is defined within the outer housing and having an outlet forward of the shower wall.

13. The body spray of claim 12, wherein the outlet of the leakpath is at least one of between the bonnet nut and the faceplate, and between the shower wall and the faceplate.

14. A body spray comprising:

an outer housing supported within a shower wall, the outer housing including a chamber extending along a longitudinal axis;

an inner waterway fluidly coupled to the outer housing, the inner waterway including a longitudinally extending shaft extending between an inner end and an outer end, wherein water pressure causes the inner waterway to extend longitudinally outwardly from the outer housing from a retracted position to an extended position;

a sprayhead fluidly coupled to the inner waterway; and a pivot point supported by the outer end of the inner waterway and about which the sprayhead pivots, the pivot point being positioned rearward of the shower wall when the inner waterway is in the retracted position, and the pivot point being positioned forward of the shower wall when the inner waterway is in the extended position.

15. The body spray of claim 14, further comprising a valve body configured to be supported within the shower wall, and the outer housing is received within the valve body.

16. The body spray of claim 14, further comprising:

a faceplate supported by the outer housing and configured to be positioned external to the shower wall; and a bonnet nut coupled to the outer end of the inner waterway;

wherein a front spray surface of the sprayhead is flush with an outer surface of the faceplate when the inner waterway is in the retracted position, and an outer surface of the bonnet nut is flush with the outer surface of the faceplate when the inner waterway is in the extended position.

17. The body spray of claim 14, wherein the pivot point is defined by a ball having a semi-spherical outer surface and a water passageway extending therethrough.

18. The body spray of claim 14, wherein the outer housing includes an outer housing body, a lip seal received within the outer housing body, and a retainer coupled to the outer housing body, the lip seal positioned concentrically around the inner waterway and providing a dynamic seal between the outer housing and the inner waterway.

19. The body spray of claim 18, wherein the outer housing body extends between an inner end and an outer end, the outer housing body including a flange at the outer end, and an annular seal is positioned intermediate the flange and an outer surface of the shower wall.

20. The body spray of claim 14, wherein the sprayhead is configured to pivot about an axis extending perpendicular to the longitudinal axis.

21. The body spray of claim 20, wherein the sprayhead is configured to pivot about the axis perpendicular to the longitudinal axis by at least 25 degrees in a first direction relative to the longitudinal axis, and at least 25 degrees in a second direction relative to the longitudinal axis, the second direction being opposite to the first direction.

22. The body spray of claim 14, wherein the sprayhead includes at least three degrees of freedom, the three degrees of freedom including rotation about the longitudinal axis, pivoting about a first transverse axis extending perpendicular to the longitudinal axis, and pivoting movement about a second transverse axis extending perpendicular to the longitudinal axis and the first axis.

23. The body spray of claim 14, further comprising an end housing fluidly coupled to the inner end of the inner waterway, a flow restrictor supported within the end housing.

24. The body spray of claim 14, wherein the inner waterway includes a restricting orifice to provide a pressure differential to force the waterway toward the extended position in response to water flowing therethrough.

25. The body spray of claim 14, wherein the sprayhead includes an outer shell, an inner cover cooperating with the outer shell to define a chamber, and a spray engine received within the chamber and fluidly coupled to the inner waterway.

26. The body spray of claim 14, further comprising:

a faceplate supported by the outer housing and configured to be positioned external to the shower wall; and a bonnet nut coupled to the outer end of the inner waterway;

wherein a leakpath is defined within the outer housing and having an outlet forward of the shower wall, the outlet of the leakpath is at least one of between the bonnet nut and the faceplate, and between the shower wall and the faceplate.

27. A body spray comprising:

an outer housing;

an inner waterway received within the outer housing, the inner waterway including a longitudinally extending shaft extending between an inner end and an outer end, a pivot coupling supported by the outer end of the shaft, wherein water pressure causes the inner waterway to extend longitudinally outwardly from the outer housing from a retracted position to an extended position; and a sprayhead fluidly coupled to the pivot coupling of the inner waterway, wherein the sprayhead is configured to be uncoupled from the inner waterway when in the extended position;

wherein the outer housing includes an outer housing body, and a lip seal is received within the outer housing body, the lip seal positioned concentrically around the inner waterway and providing a dynamic seal between the outer housing and the inner waterway to accommodate axial movement and rotational movement of the inner waterway relative to the outer housing.

28. The body spray of claim 27, wherein the pivot coupling of the inner waterway includes a ball having a semi-spherical outer surface and a water passageway extending therethrough.

29. A body spray comprising:

an outer housing;

an inner waterway received within the outer housing, the inner waterway including a longitudinally extending shaft extending between an inner end and an outer end, a pivot coupling supported by the outer end of the shaft, wherein water pressure causes the inner waterway to extend longitudinally outwardly from the outer housing from a retracted position to an extended position; and a sprayhead fluidly coupled to the pivot coupling of the inner waterway, wherein the sprayhead is configured to be uncoupled from the inner waterway when in the extended position;

wherein the pivot coupling of the inner waterway includes a ball having a semi-spherical outer surface and a water passageway extending therethrough;

wherein the sprayhead is threadably coupled to the ball.

30. The body spray of claim 29, further comprising a set screw supported within the ball to prevent unthreading of the sprayhead from the ball.

31. The body spray of claim 29, wherein the ball includes flats for engaging a tool and preventing rotation of the ball during threading to the sprayhead.

* * * * *

UNITED STATES PATENT AND TRADEMARK OFFICE

CERTIFICATE OF CORRECTION

PATENT NO. : 9,242,262 B2
APPLICATION NO. : 13/481103
DATED : January 26, 2016
INVENTOR(S) : Todd Andrew Huffington et al.

It is certified that error appears in the above-identified patent and that said Letters Patent is hereby corrected as shown below:

Title page, item (57) Abstract, should read as follows:

-- A body spray configured to be supported within a shower wall. The body spray includes an outer housing and an inner waterway supporting a sprayhead for axial movement relative to the outer housing. Water pressure against the inner waterway causes the sprayhead to move axially outwardly from a retracted position to an extended position. --.

Signed and Sealed this
Twenty-sixth Day of April, 2016

Michelle K. Lee

Michelle K. Lee
*Director of the United States Patent and Trademark Office*